United States Patent [19]

Kao et al.

[11] Patent Number: 4,962,603

[45] Date of Patent: Oct. 16, 1990

[54] QUICK-ALIGNING, LASER-PRINTABLE INDEX TABS

[75] Inventors: Kim Y. Kao, Alhambra; Stephanie A. Streeter, Pacific Palisades, both of Calif.

[73] Assignee: Avery International Corporation, Pasadena, Calif.

[21] Appl. No.: 345,086

[22] Filed: Apr. 28, 1989

[51] Int. Cl.[5] ..... G09F 3/00

[52] U.S. Cl. ..... 40/641; 24/DIG. 11

[58] Field of Search ..... 40/641; 283/74, 101; 24/DIG. 11

[56] References Cited

U.S. PATENT DOCUMENTS

| | | | |
|---|---|---|---|
| 1,116,682 | 11/1914 | Dittman | 24/DIG. 11 |
| 1,848,098 | 3/1932 | Aigner | 40/641 |
| 3,001,306 | 9/1961 | Wilkinson | 40/641 |
| 3,054,202 | 9/1962 | Scholfield | 40/641 |
| 3,205,597 | 9/1965 | Stern | 40/641 |
| 3,425,145 | 2/1969 | Newton | 40/641 |
| 3,938,268 | 2/1976 | Gilhula | 40/641 |
| 4,201,403 | 5/1980 | Turner | 40/641 |
| 4,499,132 | 2/1985 | Janssen | 40/641 |

FOREIGN PATENT DOCUMENTS

| | | | |
|---|---|---|---|
| 0857096 | 12/1970 | Canada | 40/641 |
| 1565587 | 3/1969 | France | 40/641 |

*Primary Examiner*—Victor N. Sakran

*Attorney, Agent, or Firm*—Poms, Smith, Lande & Rose

[57] ABSTRACT

An index tab for mounting on a sheet member, which is provided with keying means in the form of a protrusion, comprises a mainly planar base sheet. A first side of the base sheet comprises a non-adhesive printing surface and a second side of the base sheet includes an adhesive coating. A non-adhesive region disposed on the second side forms an adhesive-free pocket for guiding and receiving the keying means when the base sheet is folded about an intermediate fold line for mounting on the sheet member.

6 Claims, 2 Drawing Sheets

QUICK-ALIGNING, LASER-PRINTABLE INDEX TABS

FIELD OF THE INVENTION

The invention relates to index tabs, in particular, to index tabs which enable easy alignment on folder edges and which are suitable for laser printing.

BACKGROUND OF THE INVENTION

Index tabs for quick identification and selection of file folders are a regular feature of almost every modern office. Typically, these tabs are located on the edges of folders which are stacked or hung, or are provided as markings on certain pages of books, notebooks, or other sheet material. In order to facilitate scanning and selection of the folders or pages, the tabs are staggered with respect to each other; for example, the tab mounted on the edge of a subsequent folder is positioned just far enough to the right of the tab mounted on the edge of the immediately preceding folder that the identifying text written on both tabs can be seen when the folders are stored next to one another.

In general, indexing tabs are manufactured in one of two ways: the tabs may be formed as protrusions of the folders or pages themselves, or the tabs may comprise separate elements which are secured to the folders or pages.

Forming index tabs as protrusions of the folders themselves is disadvantageous, since it is difficult to print identifying text on the tabs. It is impractical to insert the entire folder into a typewriter in order to type text onto the edge protrusion, and it is difficult or impossible to run the folders directly through common office printers, especially laser printers. This drawback is all the more pronounced when the tabs are to be used to mark pages of a book. As a result, the identifying text is usually either handwritten onto the tabs, or else the text is printed on separate adhesive labels which are then placed on the corresponding tabs.

U.S. Pat. No. 4,201,403 (Turner) illustrates a simple, common form of index tab, having a portion of one surface coated with adhesive, as well as a non-adhesive printing surface. In use, identifying text is printed on the printing surface. The tab is then mounted on the edge of, e.g., a page of a book, by pressing the adhesive surface against the page so that the printing surface protrudes beyond the edge. In an alternative embodiment, both of two opposite edge portions of each tab are coated with adhesive, a printing surface being defined between the adhesive portions. The tab is mounted on an edge by folding it over the edge along an intermediate score line, whereby the coated edge portions face each other and adhere to either side of the edge region of the page.

The index tabs described in U.S. Pat. No. 3,001,306 (Wilkinson) are similarly mounted by folding them over the edge of the folder or page. To improve the ability to store and print these tabs, they are initially provided on a strip-like backing sheet, which is rolled or coiled; such a coil, however, precludes printing using typically sheet-fed printers such as laser printers. Unlike the above-mentioned tabs according to Turner, the surface of an entire side of each tab according to Wilkinson is coated with adhesive, the opposite, printing side being entirely free of adhesive. In use, each tab is removed from the coiled backing strip and is folded over the edge of the sheet to which it is to be attached so that the adhesive side faces opposite sides of the sheet, and so that a central portion of the tab protrudes beyond the edge. The adhesive surface on either side of the sheet is then pressed against the sheet, thus securing the tab.

The above-mentioned tabs according to the prior art may be printed upon much more easily than tabs formed as protruding elements of an edge; however, in order to position the tabs precisely, for example in a laterally staggered relationship on the edges of a series of folders or sheets, great care must be taken when mounting them. Furthermore, once the adhesive surface of a tab comes into contact with the sheet on which it is to be mounted, it will tend to adhere to the sheet and make it difficult to align or otherwise adjust the position of the tab. This problem is particularly pronounced when using tabs according to the Wilkinson design of U.S. Pat. No. 3,001,306, since the edge of the sheet member on which a Wilkinson tab is to be mounted must be carefully aligned between two adhesive wings.

A further disadvantage of prior art indexing tabs which are suitable for machine printing is that they are supplied either as a coil, such as the Wilkinson tabs, or on some other continuous web, such as the commercially available coiled or fan-folded, pin-fed label sheets. First, providing labels on such a continuous web backing material is cumbersome both when initially feeding the web into the printer and also when removing it; this is particularly undesirable when only a few index tabs or labels need to be printed. Second, the high-quality printing devices such as laser printers most commonly found in offices normally are sheet-fed, so that they could not be used for printing index tabs or labels according to the prior art without special adaptation.

A particular disadvantage of prior art tabs, such as the Wilkinson tabs, with fold or score lines is that fold or score lines are also made in the main printing surface of the tabs. When typing or printing on such tabs, symbols which fall on the fold or score lines will be unclear and ugly.

Accordingly, one object of the present invention is to provide index tabs suitable for group printing using sheet-fed devices such as a laser printer.

A further object of the invention is to provide index tabs which facilitate proper positioning on the edge of a sheet while minimizing the risk of inadvertent, premature adhesion.

SUMMARY OF THE INVENTION

In accordance with one aspect of the present invention, an index tab for mounting on a sheet member, which is provided with keying means, comprises a mainly planar base sheet. A first side of the base sheet comprises a non-adhesive printing surface and a second side of the base sheet includes an adhesive coating. A non-adhesive region disposed on the second side forms an adhesive-free pocket for guiding and receiving the keying means when the base sheet is folded about an intermediate fold line for mounting on the sheet member.

In accordance with a second aspect of the invention, a plurality of index tabs according to the first aspect of the invention is removeably provided on a sheet for group printing in a printing device.

DETAILED DESCRIPTION

In the following description of the preferred embodiment of the invention, it will be assumed that it is desired to affix index tabs to the edges of file folders. This is, however, solely for the sake of simplicity; the index tabs according to the invention are equally applicable for marking the edges of pages of books, notebooks, loose sheets, or any other sheet member.

Figure 1:
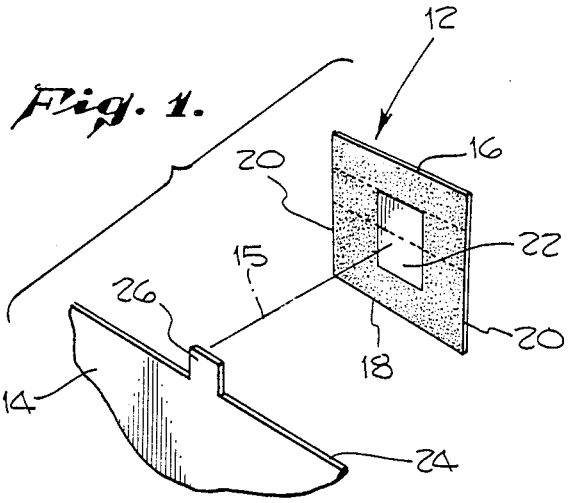
FIG. 1 is a perspective view of an index tab according to the invention, as well as of the portion of the mounting edge of a file folder, on which the index tab is to be mounted.

In FIG. 1, an index tab according to the invention is designated generally by reference numeral 12, and a file folder is designated generally by reference numeral 14. The dot-dashed 15 line indicates generally the relative position of the index tab before it is brought to the folder for mounting.

As shown in FIG. 1, the index tab 12 comprises a mainly planar base sheet exhibiting a first horizontal edge 16, a second horizontal edge 18, and two vertical edges 20. In the present exemplifying embodiment, the index tab 12 is mainly rectangular, whereby the first horizontal edge 16 and the second horizontal edge 18 are each mainly parallel to the side edges 20. It is not necessary for the index tab as a whole to be rectangular, although, as will be explained below, this is an advantageous shape. One side of the index tab 12 comprises an adhesive-free printing surface, the reverse side comprising a securing surface provided in part with an adhesive coating. In FIG. 1, the securing surface is shaded. As seen in FIG. 1, the securing surface includes a mainly rectangular, adhesive-free region 22.

The folder 14 exhibits a folder edge 24. A protrusion 26 or other keying element is disposed on the folder edge. The protrusion is preferably formed as a portion of the folder itself when the folder is manufactured, and serves to mark the position along the folder edge where the index tab is to be mounted.

Figure 2:
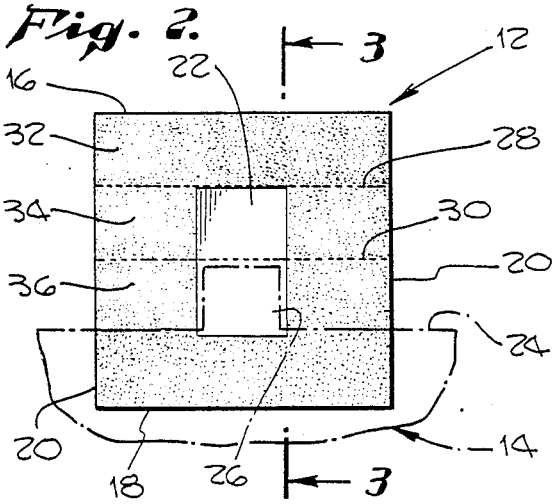
FIG. 2 is a planar view of the index tab of FIG. 1 which also illustrates the approximate relative sizes of portions of the index tab and of a keying element on the edge of the folder.

The planar view of FIG. 2 shows the index tab in greater detail, as well as the position of the tab relative to the folder edge 24 and protrusion 26. Mainly parallel to the first horizontal edge 16, for ease of folding, the index tab exhibits an outer score or fold line 28 and an intermediate score or fold line 30. The intermediate score/fold line 30 preferably mainly bisects the index tab, since this generally will minimize material waste, but bisection is not essential. A first region 32 of the index tab is defined between the first horizontal edge 16 and the outer score line 28. A second region 34 is defined between the outer score line 28 and the intermediate score line 30. A third region 36 is defined between the intermediate score line 30 and the second horizontal edge 18.

In the present exemplifying embodiment, in which the index tab is rectangular, the edges of the mainly rectangular, non-adhesive region 22 are parallel to the corresponding edges of the tab. As shown in FIG. 2, the non-adhesive region 22 extends from the outer score line 28, and is generally symmetric about the intermediate score line 30. The vertical dimension of the non-adhesive region, viewed as in FIG. 2, is preferably somewhat greater than twice the distance by which the protrusion 26 extends from the folder edge 24. As is seen in FIG. 2, the width of the non-adhesive region 22 is preferably slightly greater than the width of the protrusion 26.

Figure 3:
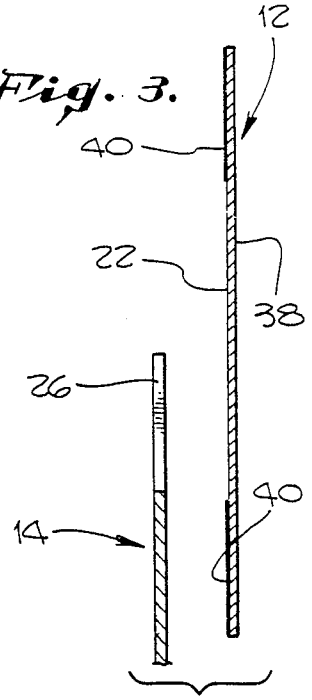
FIG. 3 is a sectional view taken along the line III—III in FIG. 2 illustrating an initial mounting position of the index tab.

FIG. 3 shows a cross-sectional view of the index tab and folder along line III—III in FIG. 2. The printing surface of the tab is designated generally by the reference numeral 38, and consists of one side of the base sheet of the index tab. The adhesive coating provided on the securing side of the tab is shown using heavy lines, and is indicated by the reference numeral 40. The figure also shows that the index tab may be formed simply as a single planar sheet, preferably of paper, cardboard, or of foldable plastic, coated on a portion of one side with a standard pressure-sensitive adhesive. The non-adhesive region 22 need therefore not be formed as a separate element or be specially coated.

In order to mount the index tab on the folder, the tab is first folded back along the outer score line 28, that is, viewed as in FIG. 2, the first region 32 is folded into the plane of the figure. The tab is then folded forward along the intermediate score line 30 approximately 180 degrees, that is, viewed as in FIG. 2, the second region 34 (and therefore also the first region 32), is folded out of the plane of the figure to approach the third region 36, until the outer score line comes close to the third region. These two folding steps may be carried out in the reverse order, but care must be taken to avoid the first region coming into contact with and adhering to the third region. After these two folds are made, the index tab will assume a configuration similar to that shown in FIG. 4.

Figure 4:
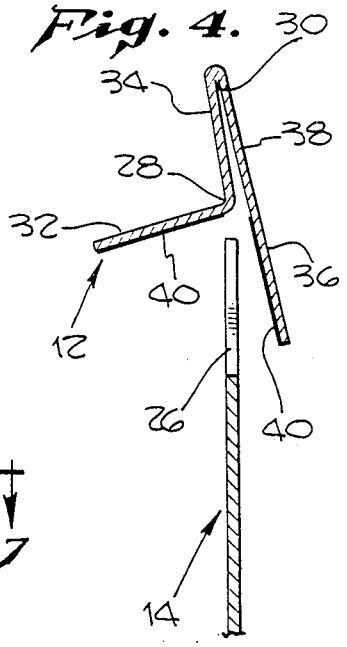
FIG. 4 is a sectional side view illustrating an intermediate mounting position of the index tab.

The angles of fold along the outer and intermediate score lines 28 and 30, respectively, need not be such as shown in FIG. 4; they should, however, be such that the opening formed between the adhesive coating of the first region and the adhesive coating of the third region is sufficiently large that there is minimal risk that the regions will prematurely adhere to each other or to the folder. The adhesive-coated areas on either side of the non-adhesive region in the second region are then pressed against the adhesive-coated areas on either side of the non-adhesive region in the third region. In this position, the portions of the non-adhesive region in the second and third regions will lie close to and face each other. Because the non-adhesive region is not coated with adhesive, an adhesive-free pocket is formed, the pocket being closed on either side by the adhesion of the coated surfaces of the second and third regions to one another.

Figure 5:
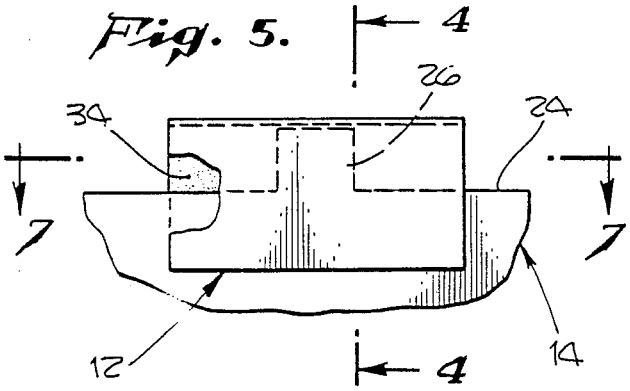
FIG. 5 is a partially cut-away planar view of the index tab and, in phantom, of the keying element, in a final mounted position.

The index tab is then mounted on the folder edge by inserting and guiding the protrusion 26 as far as possible into the pocket, whereby the closed edges of the pocket form a guide. In this position, most or all of the adhesive-coated surface of the third region 36 will lie near or against the folder. Lastly, the first region 32 of the index tab is folded down against the surface of the folder 14. By pressing the first and third regions of the tab against respective sides of the folder, the tab will adhere securely to the folder. FIG. 5 illustrates the position of the index tab on the folder edge when mounted, and shows the protrusion 26, as well as the adjacent portion of the folder edge 24, as a phantom image using dashed lines.

In the figures, both the protrusion 26 and the non-adhesive region 22 are shown as being rectangular. This shape, although the easiest to implement during manufacture, is not essential to the invention. The protrusion could, for example, be semicircular; in such case, the non-adhesive region could remain rectangular, or could be formed as two semi-circular regions defining an "hourglass" shape on the index tab. The non-adhesive region will, however, normally be symmetric about the intermediate fold line 30, each half corresponding to the shape of the protrusion 26.

It is not necessary that the non-adhesive region 22 should be centered between the vertical edges 20 of the base sheet. If it were located all the way to one side or other of the base sheet, however, when the index tab is mounted on the folder, it would be open at one edge, which is both unsightly and more prone to damage.

Figure 6:
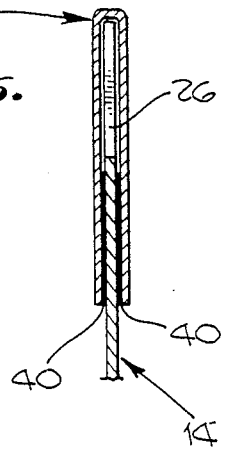
FIG. 6 is a sectional view, taken along the line VI—VI in FIG. 5, of the index tab and the folder in the final mounted position.

FIG. 6 shows a cross-sectional view, taken along line VI—VI in FIG. 5, of the index tab and folder in the mounted position. Of note is that the adhesive coated surface 40 of the index tab adheres securely to either side of the folder 14, and the pocket into which the protrusion 26 is inserted is free from adhesive in order to allow easy insertion.

Figure 7:
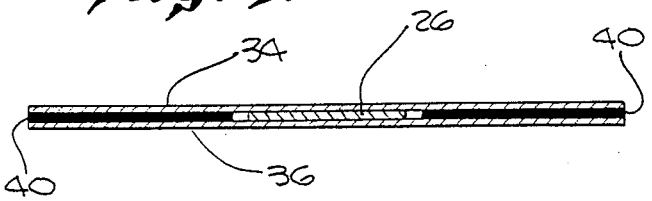
FIG 7 is a further sectional view, taken along the line VII—VII in FIG. 5, of the index tab and the folder in the final mounted position.

FIG. 7 shows a further sectional view, taken along the line VII—VII in FIG. 5, of the index tab and the folder in the final mounted position. In particular, it shows the protrusion 26 in the pocket formed by the adhesive-free region between the adhesive coating 40 on either side, and between the second and third regions 34 and 36, respectively, of the index tab. As the figure shows, in order to permit easy insertion of the protrusion into the pocket, the width of the protrusion is somewhat less than the width of the non-adhesive region, i.e. there is spacing between the edges of the protrusion and the adhesive coating on either side when the index tab is properly mounted.

The position of the protrusion or keying element 26 determines the mounting position of the index tab. Staggering the position of protrusions on a series or set of folders may be accomplished easily and once for all during manufacture of the folders. When using index tabs according to the present invention, there is therefore no need for the user to engage in timeconsuming, imprecise measurement in order to locate and align the tabs properly on respective folder edges. Consequently, the present index tabs are not only easier to mount than index tabs according to the prior art, they also guarantee a much more uniform and pleasing staggered pattern of index tabs.

Figure 8:
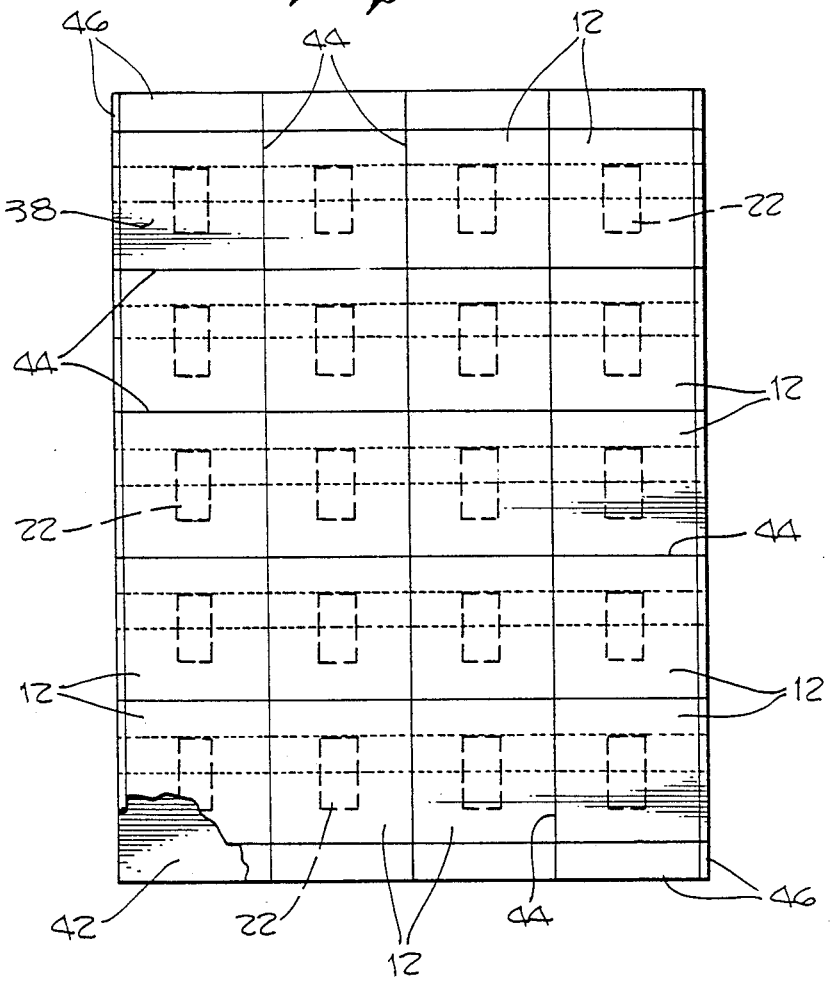
FIG. 8 illustrates a plurality of index tabs according to the present invention provided on a sheet.

In FIG. 8, a plurality of index tabs according to the invention are provided on a single backing sheet 42. By way of example only, twenty tabs are shown arranged on the backing sheet in five rows of four columns, separated by horizontal and vertical peel lines 44, which also comprise the edges of the respective tabs. The boundaries of the non-adhesive region 22 of each index tab are shown in phantom; this has been done, however, only to illustrate better the preferred relative disposition of the tabs on the backing sheet. In practice, only the uniform printing surface 38 of the tabs will be visible, the adhesive-coated side of each being in contact with and facing the backing sheet.

The backing sheet comprises a conventional non-adhesive or only slightly adhesive release layer or coating, for example containing silicone, so that index tabs remain secured to the backing sheet when in storage or during printing, but may be easily peeled from the backing sheet by the user. The sheet is supplied to the user having the adhesive securing side of the tabs facing and in contact with the release layer of the backing sheet.

A waste border 46, suitably of the same material as the printing surface of the index tabs, preferably runs around the periphery of the backing sheet. This waste border facilitates alignment of the sheet in certain printing devices, and eliminates the risk that any portion of the outermost index tabs will fall outside the effective printing region of the printer. The advantage of the rectangular shape of the index tabs, as is seen in FIG. 8, is that such a shape more efficiently covers the surface of the backing sheet, which, for almost all common printers, is itself rectangular.

The backing sheet conforms preferably to the dimensions of any standard office sheet size, e.g. $8\frac{1}{2}'' \times 11''$, A4, legal size, etc. In use, the sheet 46 with the index tabs is inserted either automatically or manually into a printer, whereupon text chosen by the user is printed in a single pass in the normal manner onto one or more of the index tabs. Although the full advantage of the invention is to be had when using automatic, rapid printing devices such as laser printers, the sheet of index tabs may of course also be inserted into a typewriter. Usually, text will be printed in the second region 34 and the upper half of the third region 36 of any given index tab so that it will extend beyond the edge of the folder the tab is mounted on. The entire printing surface of any given tab may, however, of course be used. Note further that since the third region 36, which, in the illustrated embodiment comprises approximately half of the printing surface, is neither scored nor folded, no text printed in this region will be distorted or blurred because of symbols falling on any uneven fold or score line. After printing, a tab may be mounted easily onto the edge of a file folder by peeling it from the backing sheet and folding and positioning it as described above.

For sheet members which are not provided with keying means such as the protrusion 26 (see FIG. 5), an alternative embodiment of the present index tab has a uniform adhesive surface, that is, it has no non-adhesive central region. It retains, however, the placement of fold/score lines shown in FIG. 2. When preparing this alternative index tab for mounting on a mounting edge of a sheet member, the tab is first folded about the first score line 28 so that the first region 32 forms approximately a right angle with the second region 34. The tab is then folded about the intermediate fold/score line 30 until the second region 34 comes into contact with and adheres to the third region 36. In this position, the first region 32 will form an approximate right angle with the remainder of the index tab. When mounting the tab on the mounting edge of the sheet member, the edge is first placed lightly against the outwardly angled first region, which thereby forms a butting alignment surface. When the edge thus rests against the first region, the tab is properly aligned relative to the mounting edge and the adhesive surface of the third region may be pressed against the sheet member. Providing such a butting alignment surface greatly facilitates proper mounting since it is much easier to place an edge against a surface than to have to fit it properly into an acute V-shaped folded tab.

What is claimed is:

1. An index tab for mounting on a sheet member, said sheet member provided with keying means comprising a protrusion of said sheet member, said index tab comprising:

a mainly planar rectangular base sheet;

a first side of the base sheet comprising a non-adhesive printing surface;

a second side of the base sheet including an adhesive coating;

a rectangular non-adhesive region disposed centrally on the second side having edges parallel to the corresponding edges of said base sheet;

said adhesive coating surrounding said non-adhesive region said second side of the base sheet forming an adhesive-free pocket for receiving and guiding the keying means when the base sheet is folded about an intermediate fold line for mounting on the sheet member;

said intermediate fold/score line dividing the base sheet into an upper portion and a lower portion and mainly bisecting the non-adhesive region into an upper section and a lower section;

said upper and lower portions being disposed on either side of the sheet member when the base sheet is in a mounted position folded about the intermediate fold/score line;

said upper and lower section of the non-adhesive region enclosing the protrusion when the base sheet is in the mounted position; and said base sheet including an outer fold/score line extending parallel to the intermediate fold/score line and dividing said upper section into a first and a second region; whereby, in an intermediate mounting position, said upper and lower sections of the non-adhesive region are located adjacent to and face each other, and said first region is folded out of alignment with said second region about said outer fold/score line.

2. An index tab for mounting on a mounting edge of a sheet member, said index tab comprising:

a mainly planar base sheet;

a first side of the base sheet comprising a non-adhesive printing surface;

a second side of the base sheet including an adhesive coating;

an intermediate fold/score line dividing said base sheet into an upper portion and an unfolded, unscored lower portion;

said upper and lower portions being disposed on either side of the sheet member when the base sheet is in a mounted position folded about the intermediate fold/score line; and an outer fold/score line extending parallel to the intermediate fold/score line and dividing said upper portion into a first and a second region; whereby, in an intermediate mounting position:

said base sheet is folded about said intermediate fold/score line, whereby said second region is disposed adjacent to said lower portion; and said first portion is folded about said outer fold/score line, whereby said upper region is folded out of alignment with said second region for forming a butting alignment surface for the alignment edge of said sheet member.

3. An index tab as claimed in claim 2, in which said base sheet is rectangular.

4. An index tab for mounting on a sheet member, said sheet member provided with keying means, said index tab comprising:

a mainly planar base sheet;

a first side of the base sheet comprising a non-adhesive printing surface;

a second side of the base sheet including an adhesive coating;

a non-adhesive region disposed on the second side forming an adhesive-free pocket for receiving and guiding the keying means when the base sheet is folded about an intermediate fold line for mounting on the sheet member;

said keying means comprising a protrusion of the sheet member;

said intermediate fold-score line dividing the base sheet into an upper portion and a lower portion and mainly bisecting the non-adhesive region into an upper section and a lower section;

said upper and lower portions being disposed on either side of the sheet member when the base sheet is in a mounted position folded about the intermediate fold/score line;

said upper and lower section of the non-adhesive region enclosing the protrusion when the base sheet is in the mounted position;

said base sheet being rectangular;

said non-adhesive region being rectangular, with edges parallel to the corresponding edges of said base sheet; and said adhesive coating surrounding said non-adhesive region on said second side of the base sheet.

5. An index tab for mounting on a sheet member, said sheet member provided with keying means, said index tab comprising:

a mainly planar base sheet;

a first side of the base sheet comprising a non-adhesive printing surface;

a second side of the base sheet including an adhesive coating;

a non-adhesive region disposed on the second side forming an adhesive-free pocket for receiving and guiding the keying means when the base sheet is folded about an intermediate fold line for mounting on the sheet member;

said keying means comprising a protrusion of the sheet member;

said intermediate fold/score line dividing the base sheet into an upper portion and a lower portion and mainly bisecting the non-adhesive region into an upper section and a lower section;

said upper and lower portions being disposed on either side of the sheet member when the base sheet is in a mounted position folded about the intermediate fold/score line;

said upper and lower section of the non-adhesive region enclosing the protrusion when the base sheet is in the mounted position; and said base sheet including an outer fold/score line extending parallel to the intermediate fold/score line and dividing said upper section into a first and a second region; whereby, in an intermediate mounting position, said upper and lower sections of the non-adhesive region are located adjacent to and face each other, and said first region is folded out of alignment with said second region about said outer fold/score line.

6. Sheet means for printing on a plurality of index tabs in a single pass through a printing device, comprising:

carrier means for removably carrying the plurality of index tabs;

alignment means;

said sheet means comprising a backing sheet provided with a release layer;

said alignment means comprising a border around the plurality of index tabs;

each of said index tabs comprising:

a mainly planar, rectangular base sheet;

a first side of said base sheet comprising a non-adhesive printing surface;

a second side of said base sheet, including an adhesive coating; as well as a non-adhesive region disposed on the second side;

an intermediate fold/score line dividing the base sheet into an upper portion and a lower portion and mainly bisecting the non-adhesive region into an upper section and a lower section;

an outer fold/score line extending parallel to the intermediate fold/score line and dividing said upper section into a first and a second region;

said plurality of index tabs being disposed in a pattern of rows and columns generally covering the backing sheet within said border; and said adhesive coating on said second side of said index tabs removably engaging the backing sheet.

* * * * *